US007427349B2

(12) United States Patent
Mukherjee et al.

(10) Patent No.: US 7,427,349 B2
(45) Date of Patent: Sep. 23, 2008

(54) FUELS HYDROCRACKING AND DISTILLATE FEED HYDROFINING IN A SINGLE PROCESS

(75) Inventors: Ujjal K. Mukherjee, Montclair, NJ (US); Kevin L. Hofer, Concord, CA (US); Darush Farshid, Larkspur, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 435 days.

(21) Appl. No.: 11/015,898

(22) Filed: Dec. 16, 2004

(65) Prior Publication Data

US 2006/0131211 A1 Jun. 22, 2006

(51) Int. Cl.
*C10G 47/02* (2006.01)

(52) U.S. Cl. ..... 208/89; 208/95; 208/111; 208/58; 208/60; 208/61; 208/74; 208/97; 208/108; 208/143

(58) Field of Classification Search ..... None
See application file for complete search history.

(56) References Cited

U.S. PATENT DOCUMENTS

| | | | |
|---|---|---|---|
| 6,200,462 | B1 | 3/2001 | Cash et al. |
| 6,623,624 | B2 | 9/2003 | Cash et al. |
| 6,787,025 | B2 | 9/2004 | Mukherjee et al. |
| 6,797,154 | B2 | 9/2004 | Mukherjee et al. |

*Primary Examiner*—Tam M. Nguyen
(74) *Attorney, Agent, or Firm*—Penny L. Prater

(57) ABSTRACT

The present invention relates to the field of hydroprocessing, and more particularly relates to a process directed to fuels hydrocracking and distillate feed hydrofining. This process has at least two stages. A relatively unconverted hydrofined product may be removed prior to the second stage, providing flexibility. In another embodiment, fresh feed may be added prior to the second stage. In both embodiments, fuels production is maintained at a constant level.

19 Claims, 4 Drawing Sheets

FUELS HYDROCRACKING AND DISTILLATE FEED HYDROFINING IN A SINGLE PROCESS

FIELD OF THE INVENTION

This invention is directed to fuels hydroprocessing employing at least two stages.

BACKGROUND OF THE INVENTION

There are numerous patents and published applications in the multistage hydroprocessing area which disclose one or more of the following features: product recycle, interstage separation and interstage feed addition. U.S. Pat. No. 6,200,462 discloses recycle of a portion of bottoms material (bottoms for first and second stages were combined and fractionated) to the first stage, where it is combined with fresh feed prior to entering the first stage. Interstage separation occurs after the first stage. The vapor stream is passed to a second stage hydrprocessing unit, and the liquid stream is fractionated.

U.S. Pat. No. 6,787,025 discloses two stage hydroprocessing with interstage separation in a hot high pressure separator. The vapor stream is subjected to further processing and the bottoms from the hot high pressure separator proceeds to fractionation. External feed is added to the vapor stream prior to further processing.

U.S. Pat. No. 6,797,154 discloses two stage hydroprocessing with interstage separation in a hot high pressure separator. External feed may be added to the vapor stream as it leaves the separator. The vapor stream undergoes fractionation and optional further hydroprocessing. The liquid stream is processed in a second hydroprocessing unit and the effluent sent to a cold high pressure separator. Heavier materials from the separator are sent to fractionation and the lighter materials are recycled to the first stage.

U.S. Pat. No. 6,623,624 discloses two stage hydroprocessing with interstage separation. Effluent from the first hydroprocessing unit passes to atmospheric separation where a first fuel product is removed, and the heavy fraction then proceeds to a vacuum separation zone where fuel and lubricant products are removed. The bottom fraction of the vacuum separation zone the proceeds to a hydrocracking zone, where additional fuel and lubricant products are removed.

In one conventional two stage hydroprocessing scenario, a fresh feed is reacted in a first hydrocracking stage. Effluent from the first stage is combined with effluent from a second stage and the blend fractionated. Distillate fuel product is recovered, and the bottoms product from the fractionator passed to a second hydrocracking stage for further conversion.

It is important to differentiate the "bleed" of a conventional two-stage hydrocracker from the deeply hydrogenated heavy product which is produced in this process. This differentiation is further discussed in the Detailed Description of the Invention.

SUMMARY OF THE INVENTION

The invention is presented for convenience as possessing two stages, although it may be possible for additional stages to be present.

The instant invention is distinguished in one embodiment from conventional two-stage hydroprocessing by the removal of a portion of the fractionator bottoms product prior to the second hydroprocessing reaction stage for use or treatment elsewhere. An alternate embodiment permits the addition of fresh feed prior to the second stage, as well as the removal of fractionator bottoms prior to the second stage. In the preferred mode, hydrocracking is occurring in both the first stage and the second stage.

The two-stage hydrocracking process of this invention is operated at conditions suitable for producing one or more distillate fuels and a clean, deeply hydrogenated heavy product. This product may be further employed in a number of processes requiring clean feeds. FCC feed, lubricating base oil feeds and ethylene cracker feeds are several examples. In this way the present process combines a two-stage hydrocracking process with a single stage distillate feed hydrotreating process in a single process. The particular features of the present process permit a great deal of flexibility in selecting the quantities of feed to be processed, and the amount and quality of the deeply hydrogenated heavy product, without compromising the amount of high quality fuel that is made in the process.

The method of this invention is summarized as follows:

A method for hydroprocessing a hydrocarbonaceous feedstock, said method employing at least two reaction zones within a single reaction loop and comprising the following steps:

(a) passing a hydrocarbonaceous feedstock to a first reaction zone in which the feedstock is contacted with a catalyst bed and hydrogen, wherein conversion is at least 40 vol %;

(b) combining the effluent of step (a) with the effluent from the second reaction zone;

(c) passing the mixture of step (b) to a fractionator, in which material boiling below a reference temperature is separated from material boiling above a reference temperature and removed as product;

(d) removing as a product at least a portion of the effluent of step (c) that boils above a reference temperature;

(e) passing the remaining portion of the effluent of step (c) that boils above a reference temperature to a second reaction zone, in which the material is contacted with a catalyst bed and hydrogen at a conversion rate of at least 30 vol %; and (f) combining the effluent of step (e) with the effluent of step (a) and passing the mixture to the fractionator of step (c).

DETAILED DESCRIPTION OF THE INVENTION

Figure 1:
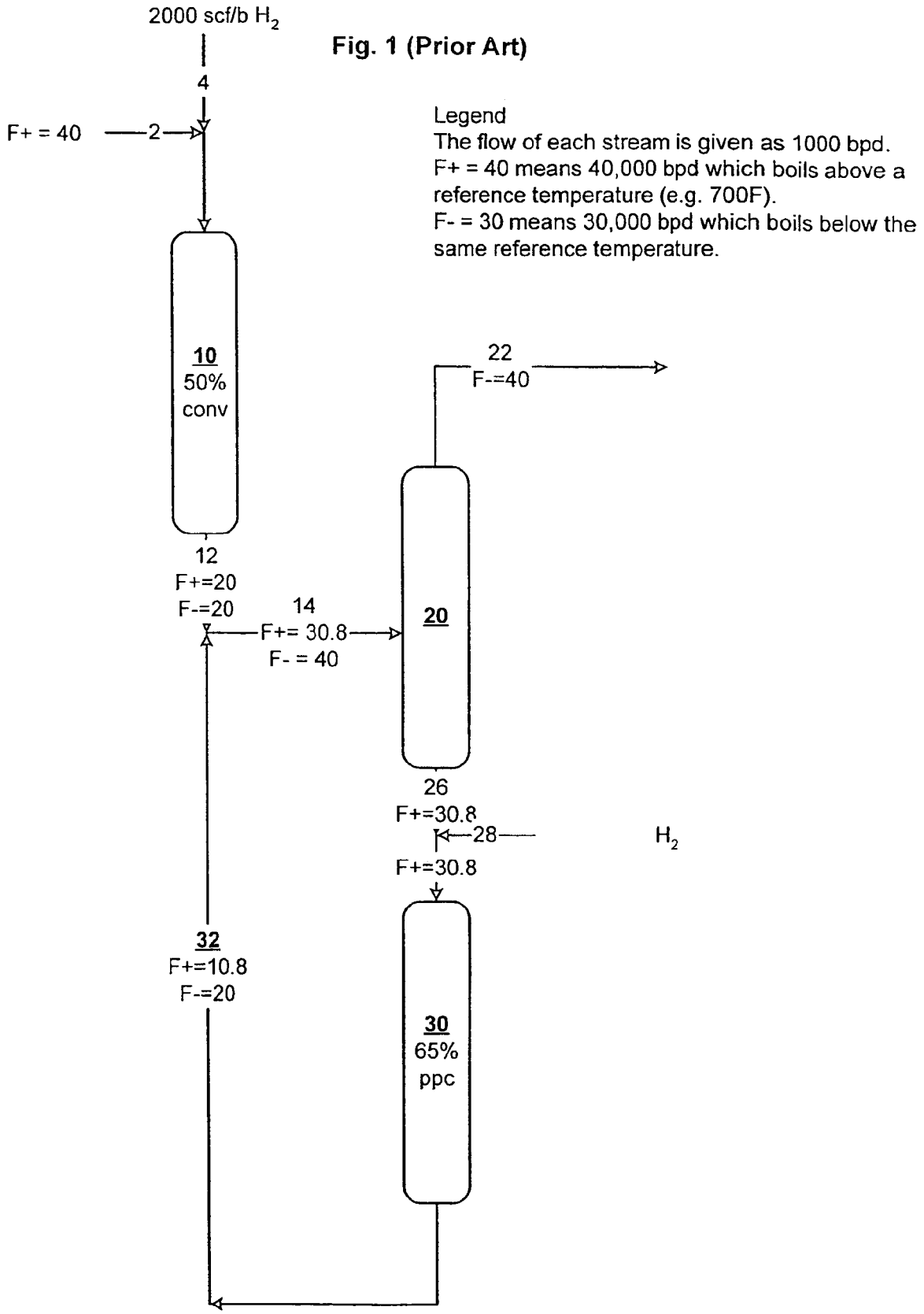
Fig. 1 (Prior Art)
FIG. 1 illustrates a conventional 2 stage hydrocracker.

This invention has several features for operating the two-stage hydrocracker to take advantage of the high quality hydrogenated heavy product. These methods include maintaining a conversion barrels balance to ensure that the process makes a constant amount of the desired distillate fuels. Also included is a method for severity balancing the two reaction stages to ensure that the catalysts in each stage foul at approximately the same rate. In so doing, the refiner has substantially more flexible two-stage hydrocracking operation than has been available before.

The features of the invention allow the refiner to:

- produce a highly hydrogenated heavy stream without decreasing the amount of distillate fuels produced during hydrocracking;
- increase the feed rate to a two-stage fuel hydrocracker without changing the severity balance between the two reaction stages;
- maintain a constant number of conversion barrels in a two-stage hydrocracker while removing a deeply hydrogenated heavy product from the hydrocracker; and
- modify both the amount and the quality of a deeply hydrogenated heavy product from a two-stage fuel hydrocracker with minimal effect on the quality and quantity of the fuel products which are also produced.

Previous two-stage hydrocracking processes employed a bleed stream somewhere in the process to remove a small amount of material from the process for process stability and to protect the second stage catalyst. However, removing this stream reduced the recovery of desired fuel products. The points below discuss how the hydrogenated heavy product stream of this invention differs from the bleed stream of conventional hydrocracking.

- In conventional processing, the bleed stream is intended only to help stabilize the reaction process, and the amount removed is minimized. Any additional amount removed results in lower yields of desired fuel products. There is no appreciation of the value of this material as a feedstock to other refinery processes.
- Traditional two-stage hydrocrackers use first stage hydrotreating to remove heteroatoms and saturate aromatics and second stage hydrocracking for molecular weight reduction. This strict separation of functions is no longer used. Recent two-stage fuels hydrocrackers maintain significant conversion in the first stage as well as in the second stage. The recycle stream is a high quality product of two hydrocracking reaction zones, with low amounts of sulfur, nitrogen and aromatics.
- There are greater demands in the refinery for deeply hydrogenated heavy products for use elsewhere (e.g. FCC feed, lubricant base oils, ethylene cracker feed).
- Integrating refinery processes means fewer pieces of equipment, with each piece having multiple functions; thereby reducing the capital investment required to achieve specific processing capability.

In brief, then, this invention involves producing a target amount of fuel products from a two-stage fuels hydrocracker at an increased feed rate, with the extra feed being recovered as varying amounts of a deeply hydrogenated heavy product. The process includes operating the two-stage hydrocracker in such a way as to adjust the conversion balance between stages to optimize the quality of the heavy unconverted oil product or to maintain a severity balance between the two reaction stages to optimize catalyst runlengths.

The instant invention employs two significant concepts, maintaining a target range of conversion barrels as well as maintaining a balance of reaction severity between the two stages.

Typical conversions at different feed rates are as shown:

| Stage 1 Feed bpd | Stage 2 Feed bpd | Stage 1 Conversion % | Stage 2 Conversion % | Mid-Dist bpd | Lube/ FCC Feed bpd | % Total Run |
|---|---|---|---|---|---|---|
| 40,000 | 0 | 60 | 40 | 36,000 | 0 | 30 |
| 50,000 | 0 | 48 | 32 | 36,000 | 10,000 | 10 |
| 60,000 | 10,000 | 48 | 32 | 36,000 | 20,000 | 20 |
| 40,000 | 10,000 | 60 | 32 | 36,000 | 10,000 | 40 |

In order to maintain a target range of barrels converted during the two-stage hydrocracking process, the first and second stages are operated at specific conversion levels. The goal is to produce a target range of barrels of cracked fuel product (e.g. boiling below the boiling range of the feed). Conversion barrels is defined as the barrels of feed cracked into a boiling range below the boiling range of the feed. Maintaining a constant range of conversion barrels in this process means producing a consistent amount of distillate fuels, regardless of the amount of feed treated, the severity of the hydrocracking process or the amount of the deeply hydrogenated heavy product which is recovered.

The two-stage process is to operate each stage at a reaction severity such that the catalysts foul at approximately the same rate in each of the two stages. Generally, first stage conversion could vary between 40 and 70 vol % and second stage conversion can vary between 30 vol % and 80 vol % per pass conversion and include the capability of processing raw feed.

This ensures that both catalysts can be economically replaced during the same shutdown. It is a feature of the invention that the severity balance is maintained, regardless of how much additional feed is sent to the first and/or second stages.

Illustrations Demonstrating Operation of a Conventional Hydrocracker and the Preferred Embodiments of the Instant Invention FIG. 1 illustrates a conventional 2-stage hydrocracker.

In this example, 40,000 bpd of feed (line 2) is passed to the first stage hydrocracker (vessel 10). Prior to entrance into vessel 10, the 2000 scf/bbl of hydrogen(line 4) is combined with line 2. 20,000 bpd are converted(50 vol % conversion) to lower boiling materials in the first stage. Both converted and unconverted material exits vessel 10 through line 12.

The unconverted 20,000 bpd is combined with 10,800 bpd of recycle (line 32). 30,800 bpd of unconverted material enters the fractionator(vessel 20) through line 14, along with 40,000 bpd of converted, lower boiling material. The lower boiling material is removed overhead through line 22. Higher boiling, unconverted material(30,800 bpd) exits the fractionator through line 26 and is combined with hydrogen(line 28). The mixture then enters the second stage hydrocracker (vessel 30). Per pass conversion in the second stage is 65 vol %.20,000 bpd of converted material exits vessel 30 through line 32, along with 10.8 bpd of unconverted material. Note that the volume expansion during hydrocracking means that more than 40,000 bpd of products are recovered from 40,000 bpd of feed. For purposes of this disclosure, we will assume no volume expansion occurs.

Figure 2:
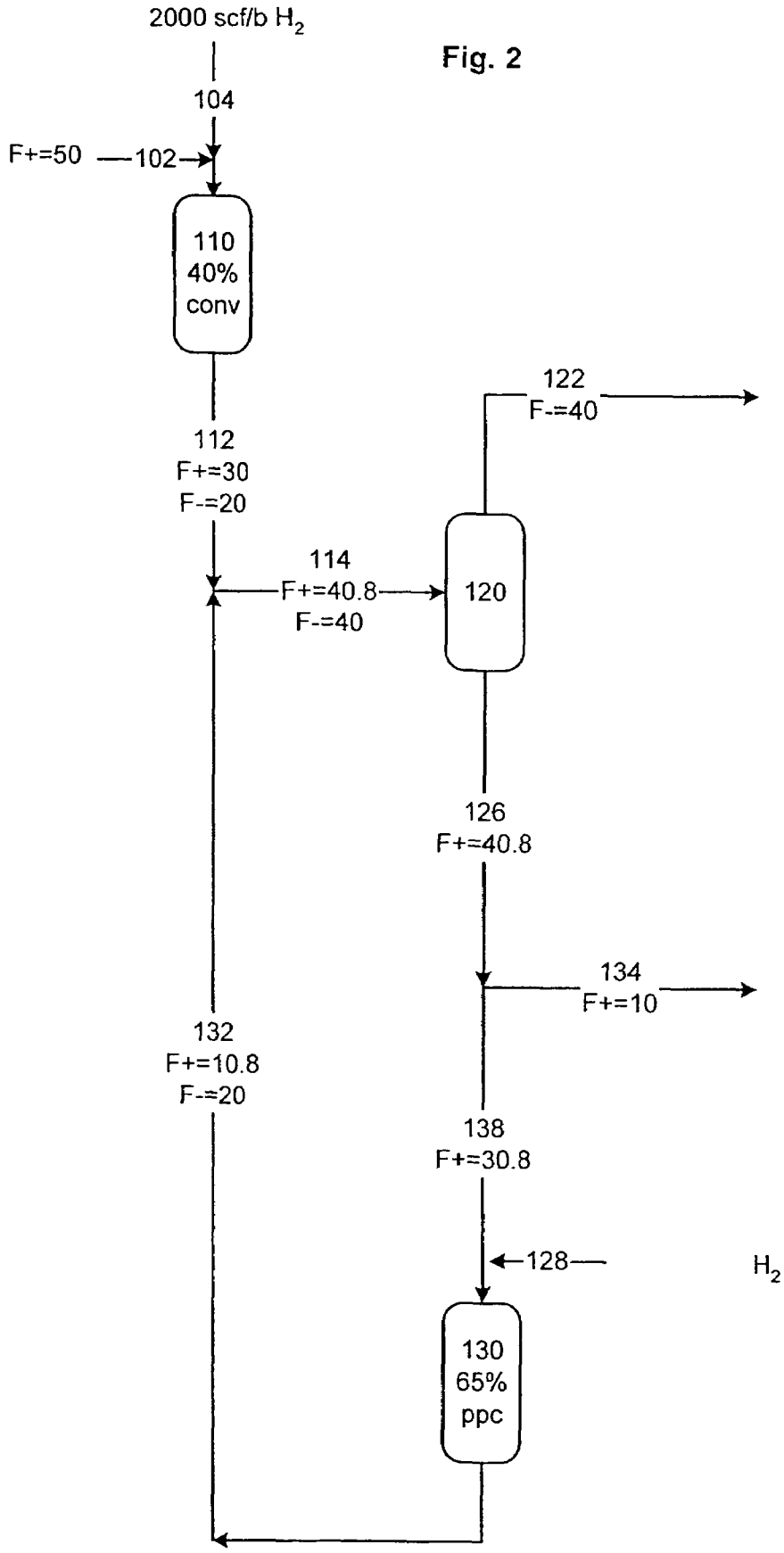
FIG. 2 illustrates the embodiment of the invention in which the amount of feed to the first stage is increased from the amount used in FIG. 1, in order to offset the amount of deeply hydrogenated heavy product removed following the first stage. The amount of fuels produced is thus kept constant.

FIG. 2: Increased First Stage Feed

FIG. 2 illustrates the process involved in removing 10,000 bpd of the deeply hydrogenated heavy product (line 134) for use elsewhere.

In order to maintain constant fuel production, feed to the first hydrocracker stage (line 102) is increased to 50,000 bpd. The feed is line 102 is combined with the 2000 scf/bbl hydrogen in line 104. The combined material passes to the first stage hydrocracker (vessel 110). The first stage hydrocracker operates at 40 vol % conversion in order to maintain the same amount of converted barrels as in FIG. 1. 20,000 bpd of converted product and 30,000 bpd of unconverted bottoms product exit vessel 110 through line 112, and is combined with the recycled effluent from the second hydrocracker stage (line 132). Line 132 contains 20,000 bpd of converted material(distillate fuels) and 10,800 bpd of unconverted material. Line 114 carries the combined material from lines 112 and 132 to fractionator 120. 40,000 bpd of converted material exit fractionator 120 through line 122. Line 126 carries 40.8 bpd of unconverted material. 10,000 bpd is removed through line 134 as deeply hydrogenated heavy product. 30,800 bpd (line 138) is combined with hydrogen(line 128) before entering second stage hydrocracker 130.

While the amount of feed to the second stage remains the same, it will be slightly harder to crack, since the conversion in the first stage was reduced relative to the base case(FIG. 1). Thus, second stage reaction severity will slightly increase in order to maintain the desired conversion. In the same way, reaction severity may be increased slightly in the first stage to create an acceptable severity balance between the two reaction stages.

Figure 3:
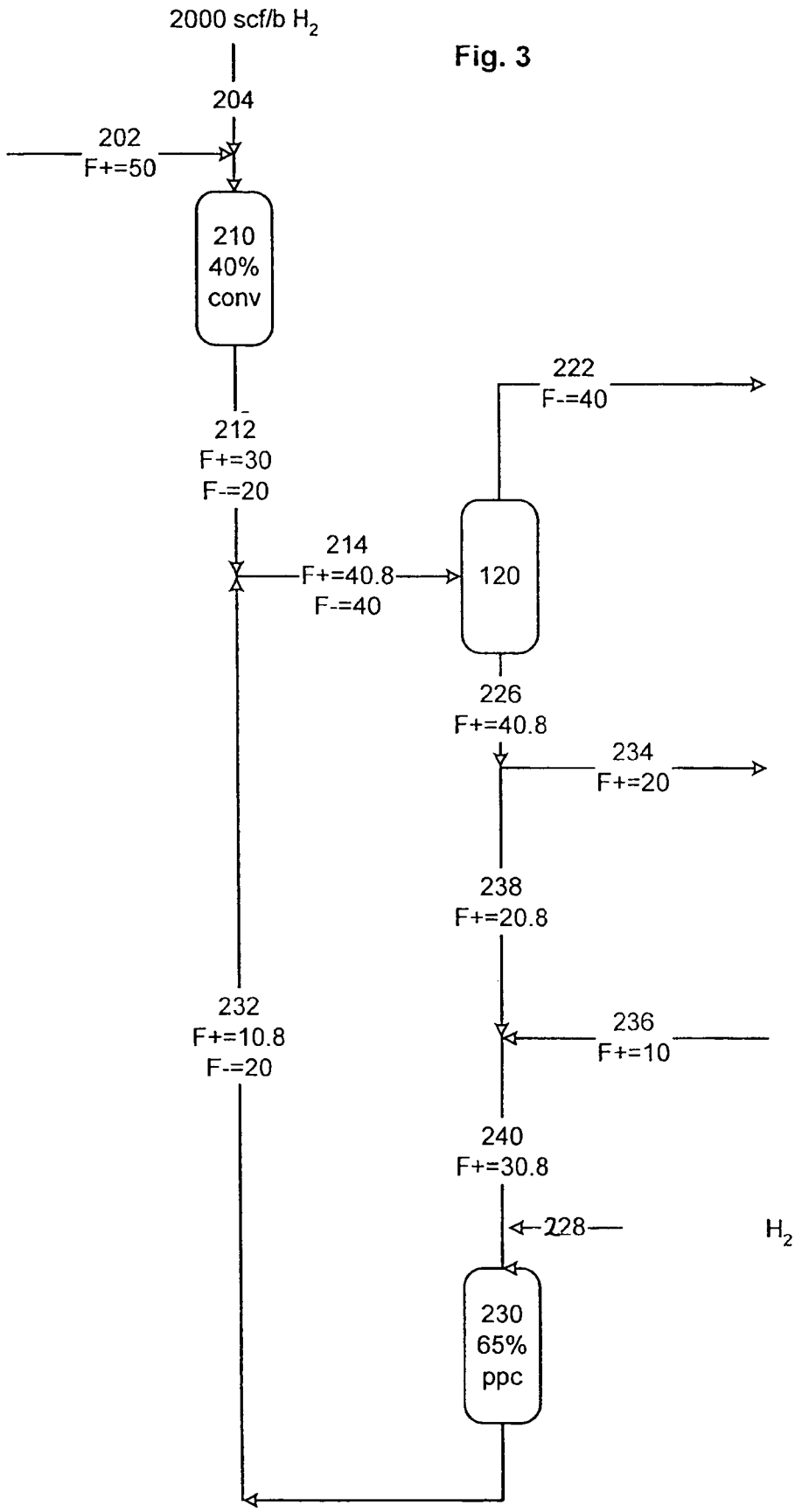
FIG. 3 illustrates the embodiment of the invention in which fresh feed is added to the second stage in order to produce a high quality deeply hydrogenated heavy product. The amount of feed to the first stage remains the same as that of FIG. 2.

FIG. 3: Increased First Stage and Second Stage Feed

FIG. 3 illustrates another embodiment of the invention. In this embodiment, the refiner has the capability of producing a moderately hydrogenated heavy product which is of slightly lower quality than that removed in FIG. 2.

The embodiment of FIG. 3 maximizes unit throughput by increasing feed to the first stage and introducing feed to the second stage. As in the process of FIG. 2, the feed rate to the first stage(line 202) is maintained at 50,000 bpd. However, 20,000 bpd of the deeply hydrogenated heavy product from the fractionator is now removed for use or treatment elsewhere, and another 10,000 bpd of fresh feed is added to the second stage. The addition of fresh feed to an otherwise clean stage is facilitated by the selection of a second stage catalyst that can tolerate higher levels of sulfur and nitrogen. It is possible to increase the reaction severity in the second stage to accommodate the potentially dirtier feed. Adjusting catalyst and reaction conditions to accommodate heavier and/or dirtier feeds is within the capabilities of the skilled practitioner. The importance of this embodiment is that 60,000 bpd of fresh feed has been processed while producing the equivalent 40,000 bpd of converted material and 20,000 bpd of heavy product. The increased amount of heavy product is at the expense of the increased reactor severity (compared to FIG. 2) in the second stage to process the fresh feed. The 20,000 bpd heavy product produced in FIG. 3 will be of slightly lower quality than the 10,000 bpd of heavy product produced in FIG. 2.

Figure 4:
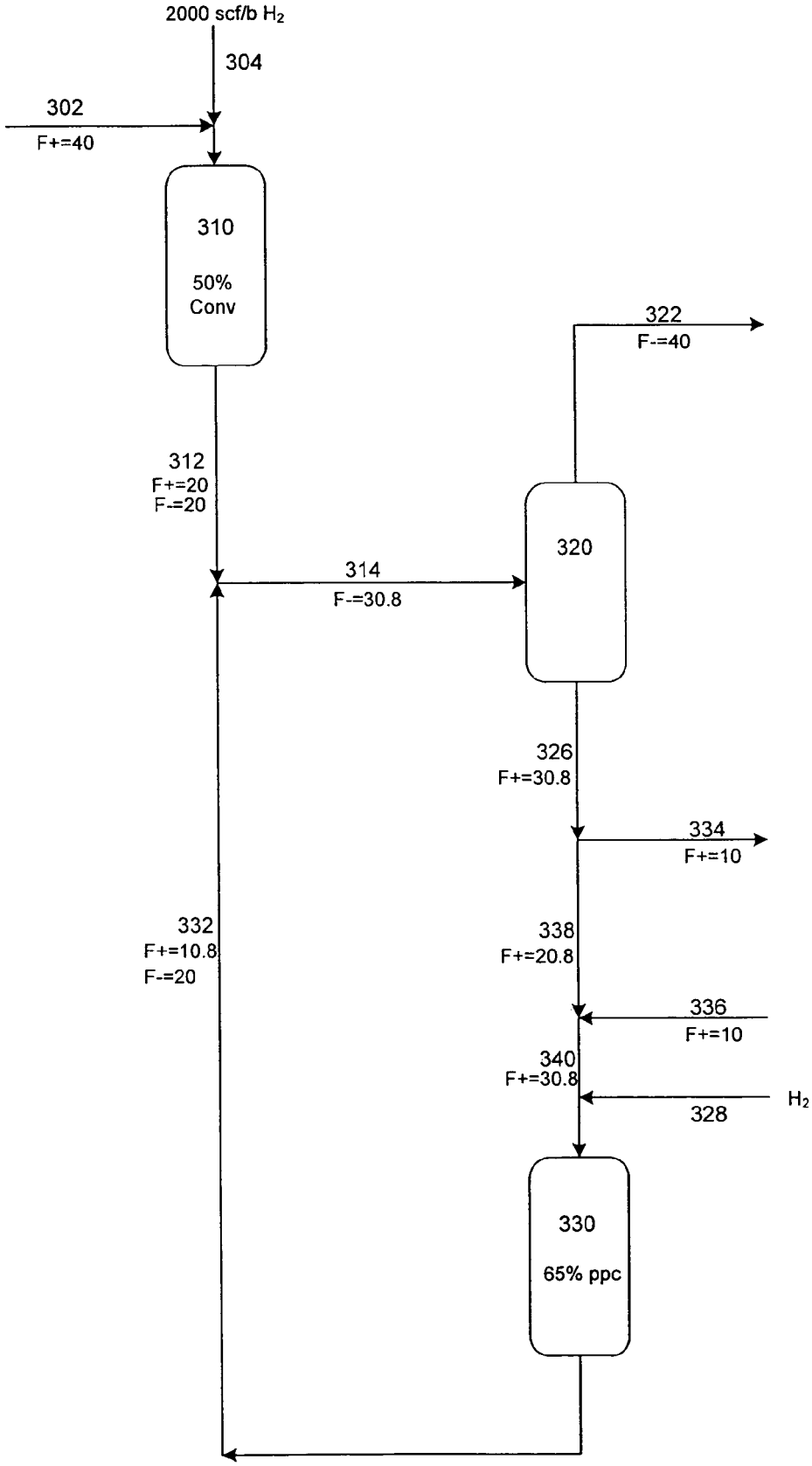
FIG. 4 illustrates the embodiment of the invention in which fresh feed is added to the second stage in order to produce the highest quality deeply hydrogenated heavy product. The amount of feed to the first stage remains the same as that of FIG. 1.

FIG. 4: Maximize Heavy Product Quality

FIG. 4 illustrates another embodiment of the invention. In this embodiment, the refiner has the capability of producing a very highly hydrogenated heavy product which is higher quality than that produced in the previous embodiments discussed. Briefly, the quality of the product is directly related to the extent of conversion that the product experiences during processing.

The embodiment of FIG. 4 maximizes heavy product quality by maintaining high conversion in the first stage and introducing feed to the second stage. As in the process of FIG. 1, the feed rate to the first stage is maintained at 40,000 bpd. Fresh feed is introduced to the second stage at a rate of 10,000 bpd allowing 10,000 bpd of the deeply hydrogenated heavy product from the fractionator to be removed for use or treatment elsewhere. As in FIG. 3 the addition of fresh feed to an otherwise clean stage is facilitated by the selection of a second stage catalyst that can tolerate higher levels of sulfur and nitrogen. The 10,000 bpd heavy product produced in FIG. 4 will be of higher quality than the 10,000 bpd of heavy product produced in FIG. 2. The importance of this embodiment is that product from the second stage has experienced both 50% conversion in the first stage and 65% PPC in the second stage. Combining the second stage effluent with the high conversion effluent from the first stage yields a heavy product of very high quality suitable for future processing to produce high value products, including Group 3 base oils.

Feedstock

A wide variety of hydrocarbon feeds may be used in the instant invention. Typical feedstocks include any heavy or synthetic oil fraction or process stream having a boiling point above 300° F. (150° C.). Such feedstocks include vacuum gas oils, heavy atmospheric gas oil, delayed coker gas oil, visbreaker gas oil, demetallized oils, vacuum residua, atmospheric residual, deasphalted oil, Fischer-Tropsch streams, FCC streams, etc.

For the first reaction stage, typical feeds will be vacuum gas oil, heavy coker gas oil or deasphalted oil. Typical feeds for the second stage would include vacuum gas oil, heavy atmospheric gas oil, light cycle oil and light coker gas oil.

Products

The instant invention is directed primarily to high quality middle distillate production as well as to production of clean deeply hydrogenated heavy material (boiling in a range greater than 650° F., but typically above 700° F.) which may be used in processes requiring clean feeds. Such processes include FCC feed, lubricating oil basestock and ethylene cracker feed.

The process of this invention is especially useful in the production of middle distillate fractions boiling in the range of about 250° F.-700° F. (121° C.-371° C.). A middle distillate fraction is defined as having a boiling range from about 250° F. to 700 F. At least 75 vol %, preferably 85 vol %, of the components of the middle distillate have a normal boiling point of greater than 250° F. At least about 75 vol %, preferably 85 vol %, of the components of the middle distillate have a normal boiling point of less than 700° F. The term "middle distillate" includes the diesel, jet fuel and kerosene boiling range fractions. The kerosene or jet fuel boiling point range refers to the range between 280° F. and 525° F. (138° C.-274° C.). The term "diesel boiling range" refers to hydrocarbons boiling in the range from 250° F. to 700° F. (121° C.-371° C).

Gasoline or naphtha may also be produced in the process of this invention. Gasoline or naphtha normally boils in the range below 400° F. (204° C.), or $C_5$-through 400° F. (204° C.). Boiling ranges of various product fractions recovered in any particular refinery will vary with such factors as the characteristics of the crude oil source, local refinery markets and product prices.

Heavy diesel, another product of this invention, usually boils in the range from 550° F. to 750° F.

Conditions

Hydroprocessing conditions is a general term which refers primarily in this application to hydrocracking or hydrotreating, preferably hydrocracking. Both first and second stage reactors are preferably fuels hydrocrackers. The first stage reactor has a conversion level of at least 40 vol %, and the second stage reactor has a conversion level of at least 30 vol. %.

Hydrotreating conditions include a reaction temperature between 400° F.-900° F. (204° C.-482° C.), preferably 650° F.-850° F. (343° C.-454° C.); a pressure from 500 to 5000 psig (pounds per square inch gauge) (3.5-34.6 MPa), preferably 1000 to 3000 psig (7.0-20.8 MPa); a feed rate (LHSV) of 0.5 $hr^{-1}$ to 20 $hr^{-1}$ (v/v); and overall hydrogen consumption 300 to 5000 scf per barrel of liquid hydrocarbon feed (53.4-356 $m^3/m^3$feed).

Typical hydrocracking conditions include a reaction temperature of from 400° F.-950° F. (204° C.-510° C.), preferably 650° F.-850° F. (343° C.-454° C.). Reaction pressure ranges from 500 to 5000 psig (3.5-34.5 MPa), preferably 1500 to 3500 psig (10.4-24.2 MPa). LHSV ranges from 0.1 to 15 $hr^{-1}$ (v/v), preferably 0.25-2.5 $hr^{-1}$. Hydrogen consumption ranges from 500 to 2500 scf per barrel of liquid hydrocarbon feed (89.1-445 $m^3H^2/m^3$ feed).

Catalyst

A hydroprocessing zone may contain only one catalyst, or several catalysts in combination.

The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Hydrotreating catalyst, if used, will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

What is claimed is:

1. A method for hydroprocessing a hydrocarbonaceous feedstock, said method employing at least two reaction zones within a single reaction loop and comprising the following steps:

(a) passing a hydrocarbonaceous feedstock to a first reaction zone in which a first feedstock is contacted with a catalyst bed and hydrogen, wherein conversion is at least 40 vol %;

(b) combining the effluent of step (a) with the effluent from the second reaction zone;

(c) passing the mixture of step (b) to a fractionator, in which material boiling below a reference temperature is separated from material boiling above a reference temperature and removed as product;

(d) removing as a product at least a portion of the material of step (c) that boils above a reference temperature;

(e) passing the remaining portion of the material of step (c) that boils above a reference temperature to a second reaction zone, in which the material is contacted with a catalyst bed and hydrogen at a conversion rate of at least 30 vol %; and (f) combining the effluent of step (e) with the effluent of step (a) and passing the mixture to the fractionator of step (c) wherein a second feedstock is combined with the material of step (c) that boils above a reference temperature prior to step (e), in order to offset the amount of product removed in step (d) and maintain a constant volume of material in the process.

2. The process of claim 1, in which a balance is maintained between the severities of the reactions occurring in each reaction zone in order to maintain a constant volume of product boiling below a reference temperature.

3. The process of claim 1, in which a constant volume of the material of step (c) that boils below a reference temperature is produced, regardless of the amount of feed treated, the severity of the process conditions or the amount of effluent of step (c) that boils above a reference temperature is removed.

4. The process of claim 1, in which the reference temperature is in the range from 650° F. through 750° F.

5. The process of claim 4, in which the reference temperature is in the preferred range from 700° F. to 725° F.

6. The process of claim 1, in which the volume of material that boils below a reference temperature comprises distillate fuel product as well as gasoline.

7. The process of claim 2, in which the catalysts of each reaction zone foul at approximately the same rate, permitting simultaneous replacement during shutdowns.

8. The process of claim 1, in which the feedstock is selected from the group of consisting of vacuum gas oils, heavy atmospheric gas oil, delayed coker gas oil, visbreaker gas oil, demetallized oils, vacuum residue, atmospheric residua, light cycle oil, light coker gas oil, deasphalted oil, Fischer-Tropsch streams, and FCC streams.

9. The process of claim 1, in which hydroprocessing comprises hydrocracking, hydrotreating or both.

10. The process of claim 9, in which fuels hydrocracking is the predominant reaction.

11. The process of claim 1, wherein the conversion in the first stage is in the range from 40 through 70 vol % and the conversion in the second stage is in the range from 30 through 80 vol % per pass.

12. The process of claim 11, in which second stage conversion is in the range from 40 through 70 vol % per pass.

13. The process of claim 1, wherein the conversion in the first stage is at least 50 vol % and the conversion in the second stage is at least 60 vol %, thereby yielding a highly hydrofined heavy product suitable for Group III waxy base oil stock.

14. The process of claim 10, wherein hydrotreating conditions comprise a reaction temperature between 400° F.-900° F. (204° C.-482° C.), a pressure from 500 to 5000 psig (3.5-34.6 MPa), a feed rate (LHSV) of 0.5 hr−1 to 20 hr−1 (v/v); and overall hydrogen consumption 300 to 5000 scf per barrel of liquid hydrocarbon feed (53.4-356 m3/m3feed).

15. The process of claim 10, wherein hydrocracking conditions include a reaction temperature of from 400° F.-950° F. (204° C.-510° C.), reaction pressure ranges from 500 to 5000 psig (3.5-34.5 MPa), LHSV ranges from 0.1 to 15 hr−1 (v/v), hydrogen consumption ranges from 500 to 2500 scf per barrel of liquid hydrocarbon feed (89.1-445 m3H2/m3feed).

16. The process of claim 1, in which the material of step (c) that boils above a reference temperature comprises clean deeply hydrogenated heavy material.

17. The process of claim 16, in which the clean deeply hydrogenated material is used as feedstock to processes selected from the group consisting of FCC feed, lubricating oil basestock and ethylene cracker feed.

18. The process of claim 1, in which the catalyst beds of the first and second reaction zones are selected from the group consisting of hydrotreating and hydrocracking catalyst.

19. The process of claim 8, in which the preferred feedstock is vacuum gas oil.

* * * * *